United States Patent [19]

Piraud

[11] 4,093,219

[45] June 6, 1978

[54] BALLS FOR SPORT

[75] Inventor: Jean-Daniel Piraud, Thiers, France

[73] Assignee: Societe de Transformation du Caoutchouc-Sotrac, Cournon, France

[21] Appl. No.: 734,935

[22] Filed: Oct. 22, 1976

[30] Foreign Application Priority Data

Oct. 30, 1975 France ..... 75 33174

[51] Int. Cl.[2] ..... A63B 41/02

[52] U.S. Cl. ..... 273/65 B; 273/65 ED; 273/58 J; 260/75 R

[58] Field of Search ..... 273/58 J, 58 BA, 65 B, 273/65 R, 65 E, 65 EC, 65 ED, 65 EE, 218, 235, 63 G, DIG. 9, 58 B, 65 EB

[56] References Cited

U.S. PATENT DOCUMENTS 1,870,604 8/1932 Coles ..... 273/65 B 2,996,212 8/1961 O'Sullivan ..... 273/DIG. 9

*Primary Examiner*—George J. Marlo

*Attorney, Agent, or Firm*—Pollock, VandeSande and Priddy

[57] ABSTRACT

The invention relates to balls for sports, for example, a football, consisting of an external wear layer surrounding a bladder which also forms the body of the ball and is made from a powdered or liquid elastomeric resin comprising a polycondensation product of at least one compound of the group consisting of the dicarboxylic acids and esters of the dicarboxylic acids having a molecular weight of less than 300 with a polyalkylene-oxyglycol whose molecular weight is between 400 and 6000, and at least one diol having a molecular weight of less than 250. The external layer, suitably of rubber or leather, is secured directly to the bladder/body by, preferably, a polyurethane-base adhesive.

2 Claims, 4 Drawing Figures

Figure 1:
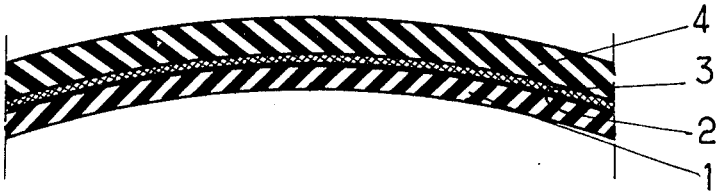

Proir Art.

Proir Art

BALLS FOR SPORT

This invention concerns improvements relating to balls for sports, for example association, rugby and other footballs, volley ball, handball and basket ball.

Known balls having a nylon body, sometimes described as balls of the American type, are normally of three-ply or four-ply construction and comprise the following components:

(a) A bladder, generally of rubber, whose function is to ensure air tightness;

(b) A body adhered to the bladder and made of threads or filaments or cloth of natural or synthetic, for instance nylon, fibres, whose function is to ensure permanence of shape, sphericity in the case of a spherical ball, to maintain its dimensions under the inflation pressure and finally to ensure the resilience or elastic properties necessary for a satisfactory bounce or rebound, and (c) A wear layer or cover, which may be fabricated of rubber, synthetic material or leather, secured upon the body.

The production of the bladder of thin rubber and then of the body adhered to the bladder, poses several problems of a practical nature which increase the cost of manufacture of a ball.

The principal phases of the manufacture of such a known ball are as follows:

(1) Production of the bladder:

A flexible-rubber mixture obtained by the malaxation or kneading of the several ingredients, namely rubber, carbon black, accelerators, sulphur and protective agents is drawn on a calender into sheets of predetermined thickness which are then cut up into pieces of bi-convex lenticular shape which are assembled, four at a time, at their perimeters after a valve body, moulded separately, has been secured by adhesive to the middle of one of the said pieces.

This preformed assembly is vulcanized in a hollow spherical mould, heated at 145° C for 7 minutes and put under an internal pressure of 7 bars by means of compressed air introduced by a tube passing through the valve body.

The walls of bladders so produced are not always of constant thickness and wastage and weakness of the assemblies results.

(2) Production of the body:

The bladder obtained as described above is inflated to a predetermined dimension after an obturating element has been placed in the valve body. Then either lenticular pieces of cloth impregnated with crude rubber are stuck by a rubber solution onto the bladder, or a considerable length of an endless filament or thread soaked in the solution is rolled on in all directions by a special machine, like a silk-worm cocoon.

This cloth or filament layer prevents the bladder from expanding excessively under the inflation pressure and, on the other hand, permits retention of its spherical form. It is, however, very difficult to obtain a perfectly spherical body in every case.

(3) Production of the cover:

A rubber mixture is prepared as for the bladder, but with omission of the lamp black and addition of loading materials and colouring materials. The mixture is drawn on a calender into sheets of predetermined thickness which are than cut up into sections of lenticular shape or into hemispheres shaped under vacuum and are placed on the bladder/body assembly four or two at a time respectively.

The assembly is vulcanized in a finishing mould, with ribs or veins and engravings, for 15 minutes, similarly to the bladder, but with a minimum pressure of 10 bars.

If the ball is to have an external cover of leather, the rubber cover is made very thin and cut panels of leather are stuck upon it by means of a polyurethane-base adhesive.

The final ball is subjected to stringent tests with respect to standards of weight and dimensions and with respect to inflation pressure and the sphericity.

The ball is then decorated with filets and/or with trade or other marks. Finally, it is packed with its inflation needle and maintenance instructions.

This mode of manufacture results in considerable wastage by rejects as a result of the aforesaid tests. The rejects are mainly due to poor sphericity.

Surprisingly, it has now been ascertained that it is possible to dispense with the separate body and to secure a wear layer directly upon a bladder thereby to produce a two-ply ball for sports use, provided that the bladder is not made from rubber, but is fabricated from a polyester elastomer of a type hereinafter defined, which gives the bladder dual-purpose characteristics i.e. air-tightness and the other necessary properties of known bladders, and also the properties associated with the body which is normally included as a separate component in prior art balls, that is to say sphericity, maintenance of dimensions and pressure and a satisfactory bounce.

FIGS. 1–4 of the accompanying drawing illustrate respectively in sequence, the cross-sections of two conventional prior art balls and of two examples of balls fabricated in accordance with the present invention. In the drawing:

FIG. 1 shows a conventional prior art three-ply ball consisting of a rubber bladder 1, a film of solution 2 serving to secure a layer of cloth or a nappe of threads or filaments 3, and an external rubber cover 4.

Figure 2:
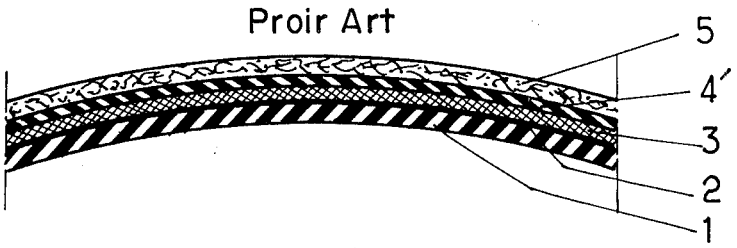

FIG. 2 shows a conventional prior art four-ply ball, with a leather cover, which is constituted similarly to the ball of FIG. 1, but in which the layer of rubber 4' is thinner than the layer 4 and is covered by a layer of leather 5.

Figure 3:
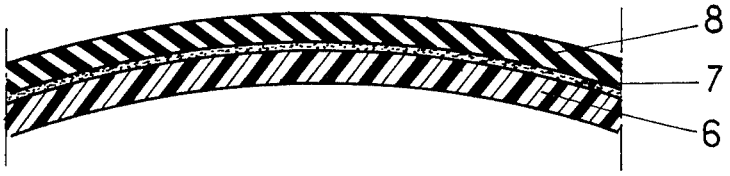

FIG. 3 shows a two-ply rubber-covered ball in accordance with the invention, constituted by a bladder 6 of the aforementioned elastomer, and a film of a polyurethane adhesive 7 which secures a cover layer of rubber 8 to the bladder.

Figure 4:
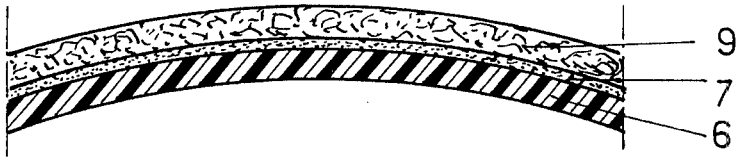

FIG. 4 shows a two-ply leather-covered ball, in accordance with the invention, whose general structure is similar to that of FIG. 3, except that the place of the external layer of rubber 8 is taken by a layer of leather 9.

According to the invention, a two-ply ball for sports comprises an external cover layer, which may be of any suitable wear resistant material, surrounding a bladder, which may be obtained by a conventional process from a powder or a liquid, which bladder also forms and acts as the body of the ball by virtue of its being made from a powdered or liquid elastomeric resin comprising a polycondensation product of at least one compound of the group consisting of the dicarboxylic acids and esters of the dicarboxylic acids having a molecular weight less than 300, with a polyalkylene-oxy-glycol whose molecular weight is between 400 and 6000, and at least one diol having a molecular weight of less than 250, for example the product sold in powder form under the trade mark "HYTREL" of Dupont de Nemours.

The employment of this elastomeric resin permits of reduction of the cost of manufacture, while providing a two-ply ball having at least the same qualities as conventional three-ply and four-ply balls.

The process of manufacture of the bladder used in the ball of the present invention, and the manner of securing the wear resistant cover layer to that bladder are per se known and need not be described in detail. The essential characteristic of the invention is the constitution of the material from which the composite bladder/body is manufactured.

However principal phases of a suitable mode of manufacture of a ball in accordance with the invention are as follows:

(1) Production of the composite bladder/body:

The polyester elastomer identified above is moulded centrifugally by rotating a hollow mould charged with a precise amount of the elastomer in the form of a fine powder. The mould is rotated simultaneously about two axes at right angles to each other, while the mould is moved across zones provided with heating units (250° C) and cooling units. The mould is finally moved, without rotation, towards a discharge station, whereafter a new moulding cycle is started.

The elastomer powder thrown against the mould wall by centrifugal force during rotation of the mould melts when the mould enters the heating zone and then solidfies when the mould enters the cooling zone. In 5 minutes, a composite bladder/body is obtained which is substantially perfectly spherical and of uniform wall thickness.

The elastomer used in the composite bladder/body of the present invention is flexible by reason of its texture, but has a very small elongation which is precisely determinable and controllable. As a result, a separate body component of cloth, thread or filament is redundant and unnecessary.

Furthermore, the valve body used in the ball, when the ball is of the inflatable type, can also be produced by the aforementioned centrifugal moulding operation, which eliminates the risk of poor air tightness arising from the adhesive hitherto used for the attachment of a separate valve body to a bladder in prior art ball fabrication techniques.

The reduced number of operations and of starting materials is to be noted.

The elastomer specified above is very resistant to tearing, has spring-like resilience and is inert to chemical substances likely to be encountered.

(2) Production of the wear-resistant cover:

The procedure is the same as for the above described conventional prior art mode of manufacture, except that the adhering of the cover to the bladder is effected with a polyurethane-base adhesive.

The tests to which the two-ply ball of the present invention is submitted are the same as those employed for the conventional manufacture of prior art three-ply balls, but very little waste by rejects is found, because the number of manufacturing operations used in the present invention are fewer and the sphericity of the composite bladder/body of the present invention is more perfect, due particularly to the use of the aforementioned starting materials for which constant characteristics can be ensured.

In contrast with the known ball of FIG. 2, it is not necessary in the present invention to provide a rubber layer between the composite bladder/body and the leather cover layer 9 in FIG. 4, as the leather is stuck directly to the elastomer by the film 7 of polyurethane adhesive, which simplifies manufacture.

I claim:

1. A two-ply ball for use in sports activities, consisting of an external cover layer fabricated of a wear-resistant material surrounding and secured to a composite bladder/body forming the inner layer in the ball, said composite bladder/body layer being fabricated from an elastomeric resin comprising a polycondensation product of at least one compound of the group consisting of the dicarboxylic acids and esters of the dicarboxylic acids having a molecular weight of less than 300 with a polyalkylene-oxyglycol whose molecular weight is between 400 and 6,000, and at least one diol having a molecular weight of less than 250.

2. A ball according to claim 1 wherein said external cover layer is fabricated of leather or rubber, and is secured to said composite bladder/body by an intervening film of a polyurethane-base adhesive which extends continuously between the facing surfaces of said cover layer and composite bladder/body.

* * * * *